US008287801B2

(12) United States Patent
Yasuda et al.

(10) Patent No.: US 8,287,801 B2
(45) Date of Patent: Oct. 16, 2012

(54) OPERATION METHOD OF FLASH SMELTING FURNACE AND RAW MATERIAL SUPPLY APPARATUS

(75) Inventors: Yutaka Yasuda, Tokyo (JP); Tatsuya Motomura, Tokyo (JP)

(73) Assignee: Pan Pacific Copper Co., Ltd., Tokyo (JP)

( * ) Notice: Subject to any disclaimer, the term of this patent is extended or adjusted under 35 U.S.C. 154(b) by 0 days.

(21) Appl. No.: 12/889,999

(22) Filed: Sep. 24, 2010

(65) Prior Publication Data

US 2011/0074070 A1 Mar. 31, 2011

(30) Foreign Application Priority Data

Sep. 30, 2009 (JP) ..... 2009-228517

(51) Int. Cl.
*C22B 9/00* (2006.01)

(52) U.S. Cl. ..... 266/44; 266/216; 266/175

(58) Field of Classification Search ..... 266/44, 266/216, 175
See application file for complete search history.

(56) References Cited

U.S. PATENT DOCUMENTS

| | | | | |
|---|---|---|---|---|
| 4,326,702 | A | 4/1982 | Oueneau et al. | |
| 4,331,087 | A | 5/1982 | Kunttu et al. | |
| 4,334,919 | A * | 6/1982 | Queneau et al. | 75/414 |
| 5,180,423 | A | 1/1993 | Marcuson et al. | |
| 5,374,297 | A | 12/1994 | Schlichting | |
| 5,888,270 | A | 3/1999 | Edwards et al. | |
| 6,258,744 | B1 | 7/2001 | Beckhaus et al. | |
| 2010/0207307 | A1 * | 8/2010 | Sipila et al. | 266/175 |

FOREIGN PATENT DOCUMENTS

| | | | |
|---|---|---|---|
| CL | 216-90 | A | 8/1990 |
| CL | 127-92 | A | 4/1991 |
| CL | 936-95 | A | 4/1996 |
| CL | 1276-95 | A | 10/1996 |
| CN | 1246486 | A | 3/2000 |
| JP | 56-62933 | A | 5/1981 |
| JP | 60-248832 | A | 12/1985 |
| JP | 4-121506 | A | 4/1992 |
| JP | 2002-241855 | A | 8/2002 |
| JP | 2007-046120 | A | 2/2007 |
| WO | 2009-030808 | A1 | 3/2009 |

OTHER PUBLICATIONS

Japanese Office Action dated Feb. 14, 2012, issued in corresponding Japanese Patent Application No. 2009-228517.
Chilean Office Action dated Nov. 14, 2011, issued in corresponding Chilean Patent Application No. 1050-2010.

* cited by examiner

*Primary Examiner* — Scott Kastler
(74) *Attorney, Agent, or Firm* — Westerman, Hattori, Daniels & Adrian, LLP

(57) ABSTRACT

An operation method of a flash smelting furnace includes blowing a gas for dispersing raw material and contributing to a reaction, from a lance at an upper portion of a shaft so that the gas forms a spiral flow. A raw material supply apparatus includes a supply portion supplying raw material and a gas for dispersing the raw material and contributing to a reaction into a flash smelting furnace, wherein the supply portion has a lance provided at an upper portion of a shaft that blows the gas so that the gas forms a spiral flow.

11 Claims, 5 Drawing Sheets

26

OPERATION METHOD OF FLASH SMELTING FURNACE AND RAW MATERIAL SUPPLY APPARATUS

CROSS-REFERENCE TO RELATED APPLICATION

This application is based upon and claims the benefit of priority of the prior Japanese Patent Application No. 2009-228517, filed on Sep. 30, 2009, the entire contents of which are incorporated herein by reference.

FIELD

The present invention relates to an operation of flash smelting furnace with a raw material supply apparatus supplying raw material and reaction gas into a furnace.

BACKGROUND

A flash smelting furnace is a smelting furnace used in a smelting of oxide of nonferrous metal such as copper or nickel and a matte smelting. In the flash smelting furnace, an apparatus for supplying raw material and reaction gas into a furnace acts as an important function for determining property of the flash smelting furnace. The property of the raw material supply apparatus determines reaction efficiency and reaction progress of the raw material in a reaction shaft, and thereby determines the property and metal loss of the flash smelting furnace. It is preferable that the reaction in the reaction shaft of the flash smelting furnace progresses speedy and all raw materials react equally at the same progress rate. It is preferable that the reaction between the raw material and the reaction gas supplied into the furnace is completed in the reaction shaft. It is important to mix the raw material and the reaction gas equally in order to complete the reaction early and equalize the reaction.

Japanese Patent Application Publication No. 04-121506 and Japanese Patent Application Publication No. 2007-46120 disclose an art making spiral flow of main blast supplied into a reaction shaft from a raw material supply apparatus or controlling flow rate of the main blast in order to improve a mixing of raw material and reaction gas. Japanese Patent Application Publication No. 2002-241855 discloses a method of burning raw material in a shaft and increasing raw material temperature in order to complete a reaction in a reaction shaft early.

However, fuel cost may be increased in a case of burning a fuel in the shaft. Use of fossil fuel should be avoided in view of environmental problem. There is no report that a method of mixing the raw material and the reaction gas improves reaction condition dramatically.

SUMMARY

According to an aspect of the present invention, there is provided an operation method of a flash smelting furnace including blowing a gas for dispersing raw material and contributing to a reaction, from a lance at an upper portion of a shaft so that the gas forms a spiral flow. The spiral flow is generated in the shaft. The spiral flow promotes mixing of the raw material and the gas. Thereby, the reaction may be completed early, and the reaction may be equalized.

According to another aspect of the present invention, there is provided a raw material supply apparatus including a supply portion supplying raw material and a gas for dispersing the raw material and contributing to a reaction into a flash smelting furnace, wherein the supply portion has a lance provided at an upper portion of a shaft that blows the gas so that the gas forms a spiral flow. With the raw material supply apparatus, the spiral flow is generated in the shaft. The spiral flow promotes mixing of the raw material and the gas. Thereby, the reaction may be completed early, and the reaction may be equalized.

The lance may have a dispersing cone and an injection portion, the dispersing cone being provided at an edge portion of the lance and has a shape of hollow circular truncated cone through which the gas passes, the injection portion injecting the gas outward in a diameter direction of the dispersing cone, and the injection direction of the gas intersecting with a normal line direction of a bottom circle of the dispersing cone. With the structure, the dispersing gas injected by the injection portion generates a spiral flow around an axis of the dispersing cone with an interaction with main blast gas supplied to an outer circumference of the dispersing cone in a vertical downward direction. Therefore, the mixing of the raw material and the gas is promoted in the shaft. Thereby, the reaction may be completed early, and the reaction may be equalized.

Here, assuming that a normal line direction and a tangent line direction of a bottom circle of the dispersing cone is zero degree and 90 degrees respectively, the injection portion may inject the gas in an injection direction intersecting with the normal line direction of the bottom circle of the dispersing cone at an angle of 5 degrees to 85 degrees. With a slight angle with respect to a diameter direction, the dispersing gas generates the spiral flow with the interaction with the main blast gas supplied to the outer circumference of the dispersing cone. The spiral flow may be enhanced when the injection angle of the dispersing gas is 45 degrees to 85 degrees with respect to the normal line direction of the dispersing cone. The injection direction may be inclined to any side because the direction of the spiral flow may be any of a clockwise direction or a counterclockwise direction.

The injection direction of the gas injected by the injection portion may include an axial direction component of the dispersing cone. In this case, size and force of the spiral flow may be adjusted.

The raw material supply apparatus may further include a main blast pathway outside of the lance that supplies main blast in an axial direction of the dispersing cone. In this case, the interaction caused by the dispersing gas generates a spiral flow of the main blast gas supplied to the outer circumference of the dispersing cone in the vertical downward direction. The spiral flow may be controlled by adjusting an injection angle and flow rate of the dispersing gas.

The gas may have oxygen concentration of 20 vol % to 95 vol %. With the oxygen enriched gas, the reaction is further promoted and is completed more earlier. It is preferable that the oxygen concentration is 40 vol % to 90 vol % in order to form an optical temperature distribution in the shaft.

Flow rate of the gas may be 50 m/s to 300 m/s. The size and force of the spiral flow in the shaft may be adjusted with a combination of the flow rate and the angle of the injected gas.

The injection portion may be a plurality of injection holes injecting the gas that are formed in a lower portion of a sidewall of the dispersing cone. The dispersing cone may be exchangeable. The injection portion may be a ring-shaped nozzle that is provided at a bottom of the dispersing cone and having a plurality of injection holes arranged radially. The ring-shaped nozzle may be exchangeable.

DESCRIPTION OF EMBODIMENTS

A description will now be given, with reference to figures, of embodiments.

First Embodiment

Figure 1:
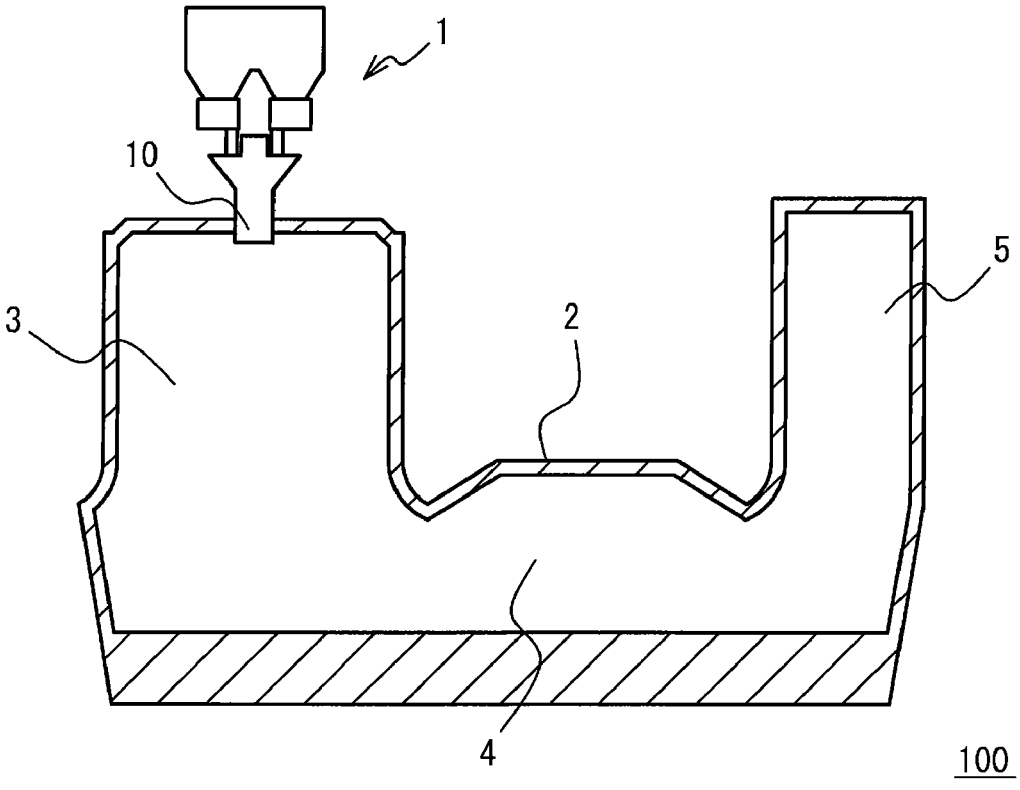
FIG. 1 illustrates a schematic view of a flash smelter for copper smelting.

A description will be given of a first embodiment with reference to the following figures. FIG. 1 illustrates a schematic view of a flash smelting furnace 100 for copper smelting. The flash smelting furnace 100 has a raw material supply apparatus 1 and a smelting body 2. The raw material supply apparatus 1 supplies a row material (copper concentrate), main blast gas for reaction, auxiliary gas for reaction, and dispersing gas into the smelting body 2. The main blast gas and the auxiliary gas may be referred to as a reaction gas. The dispersing gas also contributes to the reaction. The smelting body 2 has a reaction shaft 3, a settler 4, and an uptake 5. The copper concentrate and the reaction gas are mixed in the reaction shaft 3. The main blast gas and the auxiliary gas are oxygen-enriched air. The dispersing gas is air or oxygen-enriched gas. The reaction gas and the dispersing gas disperse and oxidize the copper concentrate.

Figure 2:
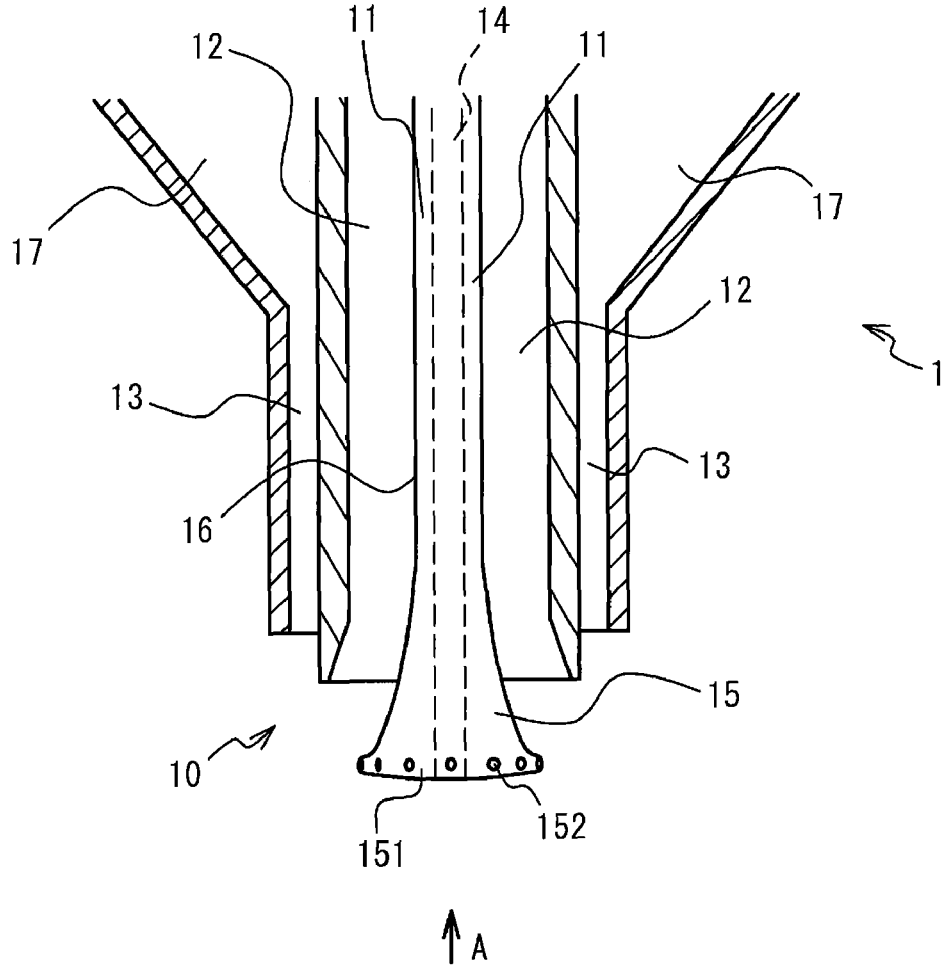
FIG. 2 illustrates a partially enlarged view of a raw material supply apparatus.

FIG. 2 illustrates a partially enlarged view of the raw material supply apparatus 1. FIG. 2 illustrates an injection portion 10 for injecting the raw material, the main blast gas, the auxiliary gas, and the dispersing gas into the reaction shaft 3.

The injection portion 10 of the raw material supply apparatus 1 has a lance 16. The lance 16 has a first pathway 11 and a fourth pathway 14. The dispersing gas passes through the first pathway 11. The auxiliary gas passes through the fourth pathway 14. The injection portion 10 has a second pathway 12 and a third pathway 13. The second pathway 12 is formed along the outer circumference of the lance 16. The third pathway 13 is formed along the outer circumference of the second pathway 12. The first pathway 11 guides the dispersing gas into the reaction shaft 3. The second pathway 12 guides the copper concentrate into the reaction shaft 3. The third pathway 13 guides the main blast gas into the reaction shaft 3 from an air chamber 17. The fourth pathway 14 guides the auxiliary gas into the reaction shaft 3.

The lance 16 has a dispersing cone 15 having a shape of hollow circular truncated cone on an edge thereof. A bottom portion of a sidewall of the dispersing cone 15 has a plurality of injection holes 152 for injecting the dispersing gas having passed through the first pathway 11 into the reaction shaft 3.

Figure 3:
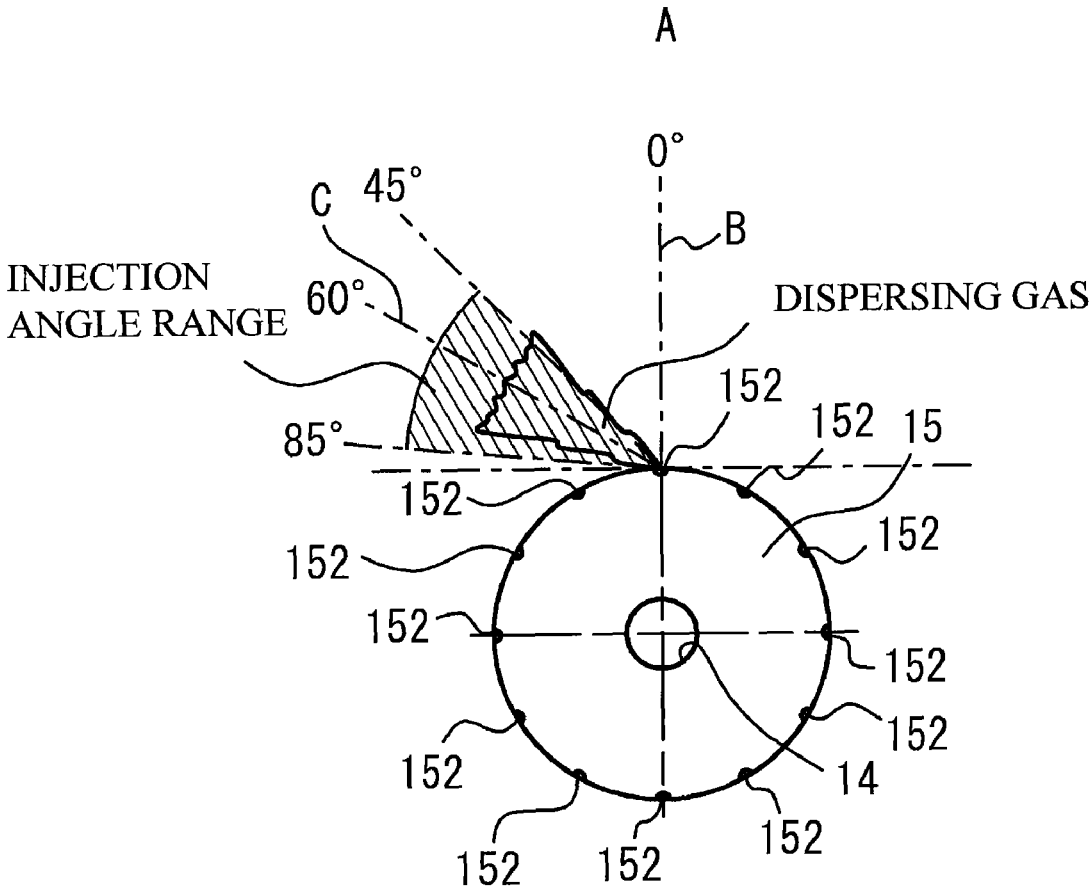
FIG. 3 illustrates a dispersing cone viewed from "A" of FIG. 2.

FIG. 3 illustrates the dispersing cone 15 viewed from "A" side of FIG. 2. As illustrated in FIG. 3, the injection holes 152 are formed radially in the dispersing cone 15. The injection holes 152 are formed so that the dispersing gas is injected outward of a diameter direction of the bottom of the dispersing cone 15. The injection holes 152 are formed so as to inject the dispersing gas in a direction intersecting with a normal line direction of the bottom of the dispersing cone 15. Assuming that a normal line direction and a tangent line direction of a bottom circle of the dispersing cone 15 is zero degree and 90 degrees respectively, an intersection angle between a normal line B of the bottom of the dispersing cone 15 and an injection direction C of the dispersing gas may be 5 degrees to 85 degrees, and is preferably 45 degrees to 85 degrees because the copper concentrate and the reaction gas are efficiently mixed. In the embodiment, the intersection angle between the normal line B and the injection direction C is set to be 60 degrees. In FIG. 3, for explanation, the dispersing gas is injected from only one of the injection holes 152. Actually, the other injection holes 152 injects the dispersing gas in the direction intersecting with the normal line direction of the bottom of the dispersing cone 15 at the angle of 60 degrees. The dispersing gas is injected from each of the injection holes 152 on the same side with respect to the normal line direction of the bottom of the dispersing cone 15.

When the injection holes 152 injects the dispersing gas into the reaction shaft 3, the dispersing gas forms a spiral flow in the reaction shaft 3. The spiral flow promotes mixing of the raw material and the reaction gas supplied into the reaction shaft 3 from the raw material supply apparatus 1. Thereby, the reaction between the copper concentrate and the reaction gas may be completed early, the reaction may be equalized, and the reaction progress speed may be equalized. The injection direction may be inclined to any side because the direction of the spiral flow may be any of a clockwise direction or a counterclockwise direction.

Spiral force of the dispersing gas generates a spiral flow of the main blast gas to be supplied into the reaction shaft 3 from the third pathway 13. Therefore, the injection portion 10 having a simple structure generates the spiral flow of the main blast gas.

The dispersing gas is injected into the reaction shaft 3 from the dispersing cone 15 at a flow rate of 50 m/s to 300 m/s. The flow rate of the injected dispersing gas can be changed. Size and force of the spiral flow can be changed by changing the flow rate. Oxygen concentrate of the dispersing gas injected into the reaction shaft 3 may be 20 vol % to 95 vol %, and is preferably 40 vol % to 90 vol % in order to form optimal temperature distribution in the reaction shaft 3.

Next, a description will be given of an effect of the raw material supply apparatus 1 in accordance with the embodiment, compared with a comparative raw material supply apparatus. The raw material supply apparatus 1 is provided in the flash smelting furnace for copper smelting. Oxygen concentration of total blast gas supplied into the reaction shaft 3 is appropriately 75% or so in view of efficiency of the reaction in the flash smelting furnace 100, depending on the raw material composition. When total amount of blast supplied into the reaction shaft 3 is 667 $Nm^3$/min, oxygen concentration of the dispersing gas is conventionally 21% and the flow rate of the dispersing gas is conventionally 42 $Nm^3$/min. In the embodiment, the gas having oxygen concentration of 60% and flow rate of 42 $Nm^3$/min is supplied into the reaction shaft 3 in the same condition of the total amount of blast and the oxygen concentration of the total blast. This allows connection between the sulfur component of the raw material and the oxygen easily, and the burning is promoted. In the matte smelting of the flash smelting furnace 100, a sulfide concentrate is supplied at 212 t/Hr, a matte including 68% copper is obtained, copper loss of slag is reduced more than 0.05% compared to the conventional apparatus. 1.25 t of copper loss is reduced when 2500 t of the slag is produced per day. This allows cost down of 240 million yen per year. Fuel is not used newly and the reaction in the reaction shaft is improved because no fuel is injected from a burner and no fuel is burned. This allows low cost and restrains global warming. There is no unreacted raw material in the settler 4 because the reaction in the reaction shaft 3 is completed. Therefore, thermal load in the settler 4 is reduced, and brick loss is reduced. Production loss caused by refractory loss trouble is avoided. And, work burden for exchanging the refractory is reduced.

Figure 4A:
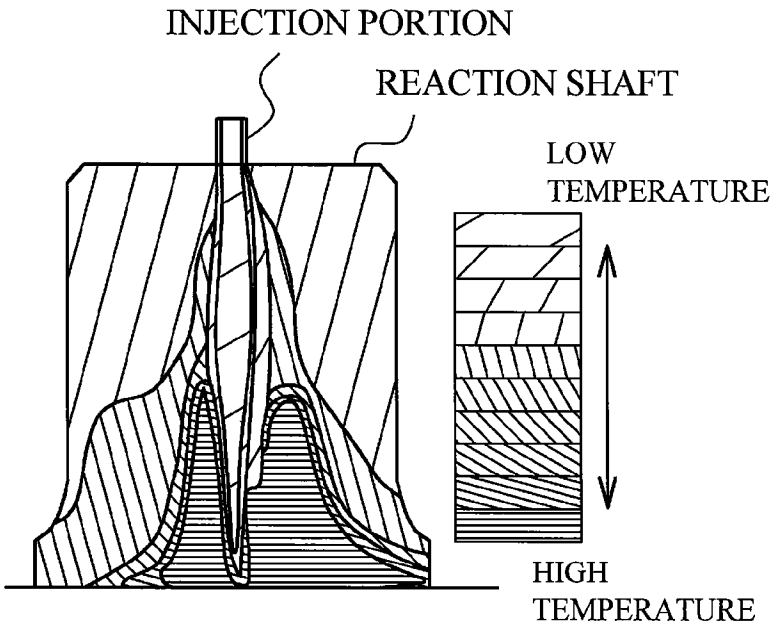
FIG. 4A illustrates a simulation result of a comparative raw material supply apparatus.
Figure 4B:
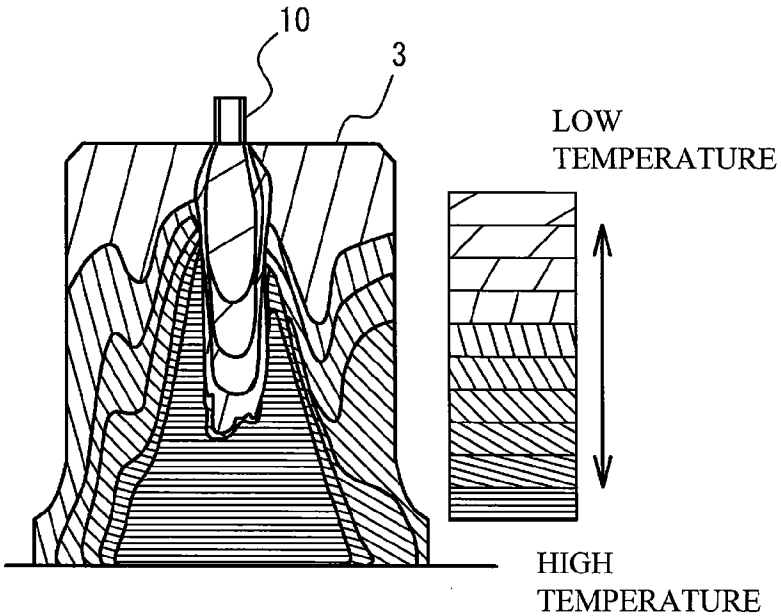
FIG. 4B illustrates a simulation result of a raw material supply apparatus in accordance with an embodiment.

Next, a description will be given of a comparison between the comparative raw material supply apparatus and the raw material supply apparatus 1 in accordance with the embodiment, with a general thermofluid analysis software program. FIG. 4A and FIG. 4B illustrate a simulation result of the general thermofluid analysis software program with respect to the temperature distribution in the reaction shaft 3. FIG. 4A illustrates the simulation result of the comparative raw material supply apparatus. FIG. 4B illustrates the simulation result of the raw material supply apparatus 1 in accordance with the embodiment. The reaction shaft structure is the same in the comparative raw material supply apparatus and the raw material supply apparatus 1.

As illustrated in FIG. 4A, a low temperature area appears from an upper portion to a bottom portion in a center portion of the reaction shaft in a condition that a spiral flow is not generated in the reaction shaft, in the comparative raw material supply apparatus. In contrast, a low temperature area appears only in a center portion in the raw material supply apparatus 1. The temperature distribution in the reaction shaft 3 is equalized. This is because the spiral flow of the dispersing gas promotes mixing of the copper concentrate and the reaction gas and completes the reaction early. The simulation result may be obtained in an actual apparatus.

There may be prepared a plurality of the dispersing cones 15 having different intersection angles between the normal line direction of the bottom of the dispersing cone 15 and the injection direction of the dispersing gas. The plurality of the dispersing cones 15 may be exchanged according to a required operation condition of flash smelting. Another dispersing cone in which the injection direction of the dispersing gas includes an axial component thereof may be manufactured. It is possible to adjust the spiral flow in the reaction shaft 3 and change the reaction condition easily according to the operation condition of the flash smelting furnace 100, if variable dispersing cones can be used. The dispersing cone 15 can be exchanged in approximately 30 minutes if the operation is temporarily stopped. Therefore, the dispersing cone 15 can be exchanged easily in a checking time of the flash smelting furnace 100. An operation plan of the flash smelting furnace 100 has no difficulty because the dispersing cone 15 can be exchanged in a short time such as the checking time.

A conventional flash smelting furnace can achieve the effect of the present invention easily if a dispersing cone is exchanged to the dispersing cone 15 in accordance with the embodiment. The spiral flow can be easily generated by exchanging of the dispersing cone, compared to a case where a pathway for guiding the main blast gas to the air chamber 17 is reconstructed, a case where a guide vane is provided in the air chamber 17, or a case where a guide vane is provided at an outlet of the main blast gas.

Second Embodiment

Next, a description will be given of another structure. A raw material supply apparatus 1 in accordance with a second embodiment has approximately the same structure as the first embodiment. The raw material supply apparatus 1 in accordance with the second embodiment has a ring-shaped nozzle 26, being different from the first embodiment. The same components as those illustrated in FIG. 2 have the same reference numerals in order to avoid a duplicated explanation.

Figure 5A:
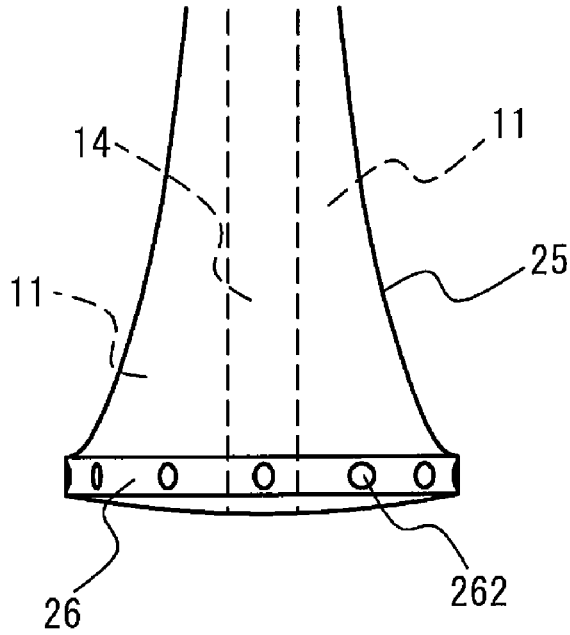
FIG. 5A illustrates a structure in which a nozzle is attached to a dispersing cone.
Figure 5B:
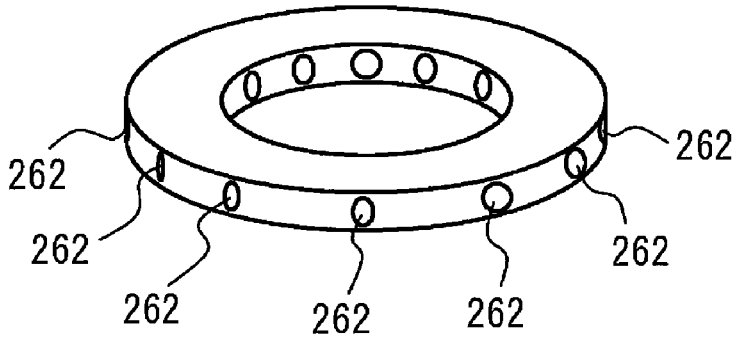
FIG. 5B illustrates a perspective view of the nozzle.

FIG. 5A illustrates a structure in which the nozzle 26 is attached to a dispersing cone 25. FIG. 5B illustrates a perspective view of the nozzle 26. The nozzle 26 has injection holes 262 for radially injecting the dispersing gas outward in a diameter direction thereof. The injection hole 262 of the nozzle 26 is formed so as to inject the dispersing gas in a direction intersecting with a normal line of a circle formed by the nozzle 26 at an angle of 60 degrees, as well as the injection hole 152 of the dispersing cone 15. The intersection angle between the normal line of the nozzle 26 and the injection direction of the dispersing gas may be 5 degrees to 85 degrees, and is preferably 45 degrees to 85 degrees because the copper concentrate and the reaction gas are efficiently mixed.

In the raw material supply apparatus 1 in accordance with the second embodiment, the spiral flow is generated in the reaction shaft 3, as well as the raw material supply apparatus in accordance with the first embodiment. The spiral flow promotes mixing of the raw material and the reaction gas. Thereby, the reaction between the copper concentrate and the reaction gas may be completed early, the reaction may be equalized, and the reaction progress speed may be equalized. The ring-shaped nozzle 26 may be exchanged to another one having a different intersection angle between the normal line direction of the circle formed thereby and the injection direction of the dispersing gas. It is therefore possible to adjust the size and the force of the spiral flow generated in the reaction shaft 3 according to the operation condition of the flash smelter 100. Variable spiral flow and burning can be generated in the reaction shaft 3, when the flow rate of the injected dispersing gas, the injection including the axial component, and the oxygen concentration may be changed as well as the first embodiment.

The present invention is not limited to the specifically described embodiments and variations, but other embodiments and variations may be made without departing from the scope of the present invention.

What is claimed is:

1. An operation method of a flash smelting furnace comprising:

blowing a gas for dispersing raw material and contributing to a reaction, from a lance at an upper portion of a shaft;

wherein the lance has a dispersing cone and an injection portion, a normal line direction and a tangent line direction of a bottom circle of the dispersing cone being 0° and 90° respectively;

wherein the injection portion injects the gas in an injection direction intersecting with the normal line direction of the bottom circle of the dispersing cone at an angle of 5° to 85° so that the gas forms a spiral flow.

2. A raw material supply apparatus comprising:

a supply portion supplying raw material and a gas for dispersing the raw material and contributing to a reaction into a flash smelting furnace, wherein the supply portion has a lance provided at an upper portion of a shaft;

wherein the lance has a dispersing cone and an injection portion, a normal line direction and a tangent line direction of a bottom circle of the dispersing cone being 0° and 90° respectively;

wherein the injection portion injects the gas in an injection direction intersecting with the normal line direction of the bottom circle of the dispersing cone at an angle of 5° to 85° so that the gas forms a spiral flow.

3. The raw material supply apparatus as claimed in claim 2, wherein:

the dispersing cone is provided at an edge portion of the lance and has a shape of hollow circular truncated cone through which the gas passes; and the injection portion injects the gas outward in a diameter direction of the dispersing cone.

4. The raw material supply apparatus as claimed in claim 3, wherein the injection direction of the gas injected by the injection portion includes an axial direction component of the dispersing cone.

5. The raw material supply apparatus as claimed in claim 3 further comprising a main blast pathway outside of the lance that supplies main blast in an axial direction of the dispersing cone.

6. The raw material supply method as claimed in claim 1, wherein the gas has oxygen concentration of 20 vol % to 95 vol %.

7. The raw material supply method as claimed in claim 1, wherein flow rate of the gas is 50 m/s to 300 m/s.

8. The raw material supply apparatus as claimed in claim 3, wherein the injection portion is a plurality of injection holes injecting the gas that are formed in a lower portion of a sidewall of the dispersing cone.

9. The raw material supply apparatus as claimed in claim 8, further comprising a second dispersing cone having a second injection portion with a different intersection angle from the injection portion and being exchangeable with the dispersing cone.

10. The raw material supply apparatus as claimed in claim 3, wherein the injection portion is a ring-shaped nozzle that is provided at a bottom of the dispersing cone and having a plurality of injection holes arranged radially.

11. The raw material supply apparatus as claimed in claim 10, further comprising a second ring-shaped nozzle with a different intersection angle from the ring-shaped nozzle.

* * * * *